US010888730B2

(12) United States Patent
Rella

(10) Patent No.: US 10,888,730 B2
(45) Date of Patent: Jan. 12, 2021

(54) STAND FOR A HEXAGONAL BAR OR A TRAP BAR FOR WEIGHTS

(71) Applicant: Daniel Rella, East Meadow, NY (US)

(72) Inventor: Daniel Rella, East Meadow, NY (US)

( * ) Notice: Subject to any disclaimer, the term of this patent is extended or adjusted under 35 U.S.C. 154(b) by 0 days.

(21) Appl. No.: 15/853,220

(22) Filed: Dec. 22, 2017

(65) Prior Publication Data

US 2018/0178052 A1 Jun. 28, 2018

Related U.S. Application Data

(60) Provisional application No. 62/569,735, filed on Oct. 9, 2017, provisional application No. 62/498,527, filed on Dec. 28, 2016.

(51) Int. Cl.
*A63B 21/072* (2006.01)
*A63B 21/075* (2006.01)

(52) U.S. Cl.
CPC ..... *A63B 21/0724* (2013.01); *A63B 21/075* (2013.01); *A63B 2209/00* (2013.01)

(58) Field of Classification Search
CPC ..... A63B 21/072–08; A63B 21/078; A63B 21/0783; A63B 23/0458; A63B 21/0724; A63B 21/075; A63B 2209/00; A63B 21/4029; A63B 71/0054; A63B 2071/0072; A63B 2023/0411
See application file for complete search history.

(56) References Cited

U.S. PATENT DOCUMENTS 1,552,073 A 9/1925 Mansfeldt
2,666,640 A * 1/1954 Jennings, Sr. ..... A63B 3/00 482/141
2,768,828 A * 10/1956 Pack ..... A63B 9/00 472/114
3,540,724 A * 11/1970 Hunter ..... A63B 21/00047 482/121
D226,771 S 4/1973 Jacobs
3,915,102 A * 10/1975 Barron ..... A47B 9/14 108/146
D261,788 S 11/1981 Burns
4,368,884 A * 1/1983 Colvin ..... A63B 21/4029 482/104
4,456,248 A * 6/1984 Smith ..... A63B 21/068 482/133

(Continued)

FOREIGN PATENT DOCUMENTS

CN 102258844 11/2011
JP H0910352 A 1/1997

*Primary Examiner* — Nyca T Nguyen
(74) *Attorney, Agent, or Firm* — Law Office Richard B. Klar; Richard B. Klar, Esq.

(57) ABSTRACT

The present invention relates to a stand for a hexagonal bar or a trap bar for weights or the combination of a stand and a hexagonal bar or a trap bar. The stand has an opening for user to enter and is enclosed on all other sides. The stand is preferably approximately 9 inches high above the ground on which it rests so that a hexagonal bar or trap bar having weight plates will be off the floor of the ground when resting on the surface areas of the stand thereby facilitating the removal and replacement of the weight plate without the need to lift the bar upward from the ground. The stand permits a user to work in the area of the stand if preferred.

29 Claims, 9 Drawing Sheets

(56) References Cited

U.S. PATENT DOCUMENTS 4,467,730 A * 8/1984 Borichevsky ..... A47B 13/06 108/157.18
4,494,750 A * 1/1985 Smith ..... A63B 21/068 482/142
4,822,034 A * 4/1989 Shields ..... A63B 21/072 482/106
D317,641 S 6/1991 Gerard
5,151,072 A * 9/1992 Cone ..... A63B 21/078 482/104
5,257,701 A * 11/1993 Edelson ..... A47B 3/10 108/116
5,403,258 A * 4/1995 Hill ..... A63B 23/0211 482/140
5,417,636 A * 5/1995 Havens ..... A63B 21/0552 482/140
5,454,771 A * 10/1995 Wilson-Hyde ..... A63B 21/00047 248/240.4
5,540,642 A * 7/1996 Sprague ..... A63B 21/015 482/123
5,605,311 A * 2/1997 McGrath ..... A47B 17/02 108/50.14
5,725,461 A 3/1998 Bogard, II
5,810,301 A * 9/1998 McGrath ..... A47B 17/02 108/152
5,810,702 A * 9/1998 Wilkinson ..... A63B 21/00047 482/130
5,971,898 A * 10/1999 Schoolfield ..... A63B 21/4029 482/104
D429,295 S * 8/2000 Ceppo ..... D21/662
6,149,556 A * 11/2000 Jordan ..... A63B 71/0036 482/104
6,206,805 B1 * 3/2001 Helton ..... A63B 23/0458 40/605
D441,813 S * 5/2001 Ceppo ..... 482/104
D443,660 S * 6/2001 Ceppo ..... D21/662
6,248,048 B1 * 6/2001 Zuckerman ..... A63B 21/00047 482/141
6,390,309 B1 5/2002 Tucker
6,634,998 B2 * 10/2003 Siaperas ..... A63B 21/04 482/123
D483,084 S * 12/2003 Gvoich ..... D21/671
6,692,417 B2 * 2/2004 Burrell ..... A63B 21/00047 482/141
6,926,643 B1 * 8/2005 Gvoich ..... A63B 23/0458 482/51
7,022,053 B2 * 4/2006 Whetstone ..... A63B 71/0036 482/104
7,036,438 B2 * 5/2006 Okamoto ..... A47B 17/02 108/153.1
7,488,282 B2 * 2/2009 Leavitt ..... A63B 23/0458 482/140
7,614,991 B2 * 11/2009 Fox ..... A63B 22/0235 482/126
7,621,224 B2 * 11/2009 Lin ..... A47B 3/0912 108/115
7,713,182 B2 * 5/2010 Bizzell ..... A63B 21/0004 482/140
D629,627 S * 12/2010 Mylet ..... D6/349
7,850,576 B2 * 12/2010 Sellke ..... A63B 63/004 273/407
8,556,781 B1 10/2013 Fitzpatrick
8,765,253 B1 * 7/2014 Smaldone ..... D04B 21/16 428/218
9,132,312 B2 9/2015 Henley
9,420,893 B1 8/2016 Clark
9,423,093 B1 * 8/2016 Clark ..... B60Q 1/503
9,517,382 B2 * 12/2016 Payne ..... A63B 23/1236
10,143,879 B1 * 12/2018 Thomas ..... A63B 21/00047
10,525,300 B1 * 1/2020 Boatwright ..... A63B 1/00
2003/0005864 A1 * 1/2003 Wen ..... A47B 3/0912 108/132
2003/0228958 A1 * 12/2003 Gvoich ..... A63B 23/0458 482/52
2007/0099773 A1 * 5/2007 Hummer, Jr. ..... A63B 71/0036 482/104
2007/0129226 A1 * 6/2007 Leavitt ..... A63B 23/0458 482/129
2008/0076641 A1 * 3/2008 Sheehan ..... A63B 21/0552 482/92
2009/0048081 A1 * 2/2009 Kamins ..... A61B 5/1071 482/131
2009/0224499 A1 * 9/2009 Dashew ..... A61H 3/04 280/87.05
2011/0172066 A1 * 7/2011 Roppolo ..... A63B 21/078 482/104
2013/0172160 A1 * 7/2013 Poole ..... A63B 21/0552 482/129
2014/0187383 A1 * 7/2014 Martin ..... A47B 83/04 482/8
2014/0274571 A1 * 9/2014 Aral Diaz ..... A63B 17/00 482/37
2015/0141222 A1 * 5/2015 DeLaCruz ..... A47C 9/002 482/142
2015/0231437 A1 * 8/2015 Welsh ..... A63B 21/068 482/142
2015/0321045 A1 * 11/2015 Garcia Lopez .... A63B 23/0205 482/142
2016/0074695 A1 * 3/2016 Lee ..... A63B 21/0783 482/104

* cited by examiner

STAND FOR A HEXAGONAL BAR OR A TRAP BAR FOR WEIGHTS

RELATED APPLICATIONS

The present application is non provisional application of provisional application Ser. 62/498,527 filed on Dec. 28, 2016 by Daniel Rella and of provisional application Ser. 62/569,735 filed on Oct. 9, 2017 by Daniel Rella.

BACKGROUND

1. Field

The present invention relates to a stand and/or a rack for a hexagonal bar or a trap bar for weights or for the combination of a stand and a hexagonal bar or a trap bar. In particular the present invention relates to a stand for hexagonal bar or a trap bar for weights on which the hexagonal bar or trap bar rests on the surface areas of the stand and is lifted sufficiently off the ground so that the bottom of the weight plates are off the ground thereby facilitating the removal and replacement for the weight plates without the need to lift the bar up from the ground.

The stand also has an opening for a user to enter and step in the hexagonal bar or trap bar without having to lift the bar upward from the stand and permits the stand area to be used for weight lifting so that the bar can be lowered on the stand without lifting the bar from the floor when placed back on the top surfaces of the stand when the exercise regime is completed.

2. The Related Art

A trap bar or a hexagonal bar is typically a hexagonally shaped exercise weight lifting bar used for weight training. It consists of an arrangement of connected bars bent into an angle, then shaped to lay flat in a plane. The bar is formed as a hexagonal or diamond shape, sized to allow a person to stand inside of the shape; usually two coaxial stub bars are located on opposite sides of the outside of the perimeter of the hollow portion for holding weight plates; and a set of parallel handles pointing forward and back, are connected inside the hollow portion. The bar is used primarily for training the trapezius muscles; shoulder shrugs and leg muscles. The stubs serve to load the trap bar with plates. The handles are used to hold the trap bar while an exercise is performed. Currently applicant is not aware of any stands that can adequately accommodate the trap bar or hexagonal bar.

U.S. Pat. No. 5,151,072 discloses an automated rack for returning a standard barbell to its rack.

U.S. Design Pat. D443,660 discloses a standard dumbbell holder stand.

SUMMARY

The present invention relates to a stand for a hexagonal bar or a trap bar 10 for weights. The stand 5 of the present invention has an opening for user to enter and is enclosed on all other sides. The stand is preferably approximately 9 inches high above the ground on which the bar 10 rests so that the weight plates can be loaded or unloaded and also the weight plates while the bar 10 rests on the stand 5 are elevated above the ground thereby facilitating the removal and replacement of the weight plates without the need to lift the bar 10 upward from the stand 5. In other words the radius of the weight plates are less than, preferably 8¼ inches in radius, the preferably 9 inch height of the stand so that the bottom of the weight plates do not touch and are above the ground where the bottom surface of the stand 5 rests.

The stand 5 permits a user to work in the area encased by the stand 5 if preferred. The stand 5 has preferably a rubber coating of the top surfaces of the stand to protect the stand 5 from the bar 10. The stand 5 can preferably having a polysided encasement except for the opening for a user to enter somewhat resembling u-shaped type configuration with corners being rounded (not shown) so as to protect the user and the corners also being rubber coated to protect the user. The area encased by the frame of the stand 5 preferably has an approximately a 1 inch thick bottom floor board or surface on the ground of the area into which the user steps into the stand 5 so that a user gets the benefit of exercising full of range of motion of as if he was squatting down to the ground when standing in the area encased by the stand 5.

BRIEF DESCRIPTION OF THE DRAWINGS

FIGS. 5A-5C show another embodiment of the present invention in which:

FIG. 5A shows a front perspective view of another embodiment of the present invention in which the connecting arms extend vertically from the bottom portion to the front portion of the rack and the corners on the top and bottom portions are curved;

FIG. 5B is a right side perspective view of the embodiment of FIG. 5A;

FIG. 5C is a left side perspective view of the embodiment of FIG. 5A;

FIG. 6A-6C describes one embodiment of the curved portion of the top and bottom portion of the rack as shown in FIGS. 5A-5C in which:

FIG. 6A shows a front perspective view of the curved portion forming the corners in the top portion and bottom portion of the rack in the embodiment of the of FIGS. 5A-5C which is preferably welded into the front and side arms of the top and bottom portions of the rack;

FIG. 6B is a rear perspective view of FIG. 6A;

FIG. 6C is a side perspective view of FIG. 6A;

FIGS. 7A-7C show a fastening tool for fastening the weights to the rack to secure the weights in place in accordance with the present invention in which:

FIG. 7A is a side perspective view of an L-shaped bracket tool adapted to secure the weights to the top of the top portion of the rack of the present invention;

FIG. 7B shows the tool on the rack from the rear of the tool in accordance with the embodiment of FIG. 7A; and FIG. 7C is another side perspective view of an L-shaped bracket tool adapted to secure the weights to the top of the top portion of the rack of the present invention in accordance with the embodiment of FIG. 7A.

DETAILED DESCRIPTION OF THE PREFERRED EMBODIMENT(S)

Figure 1:
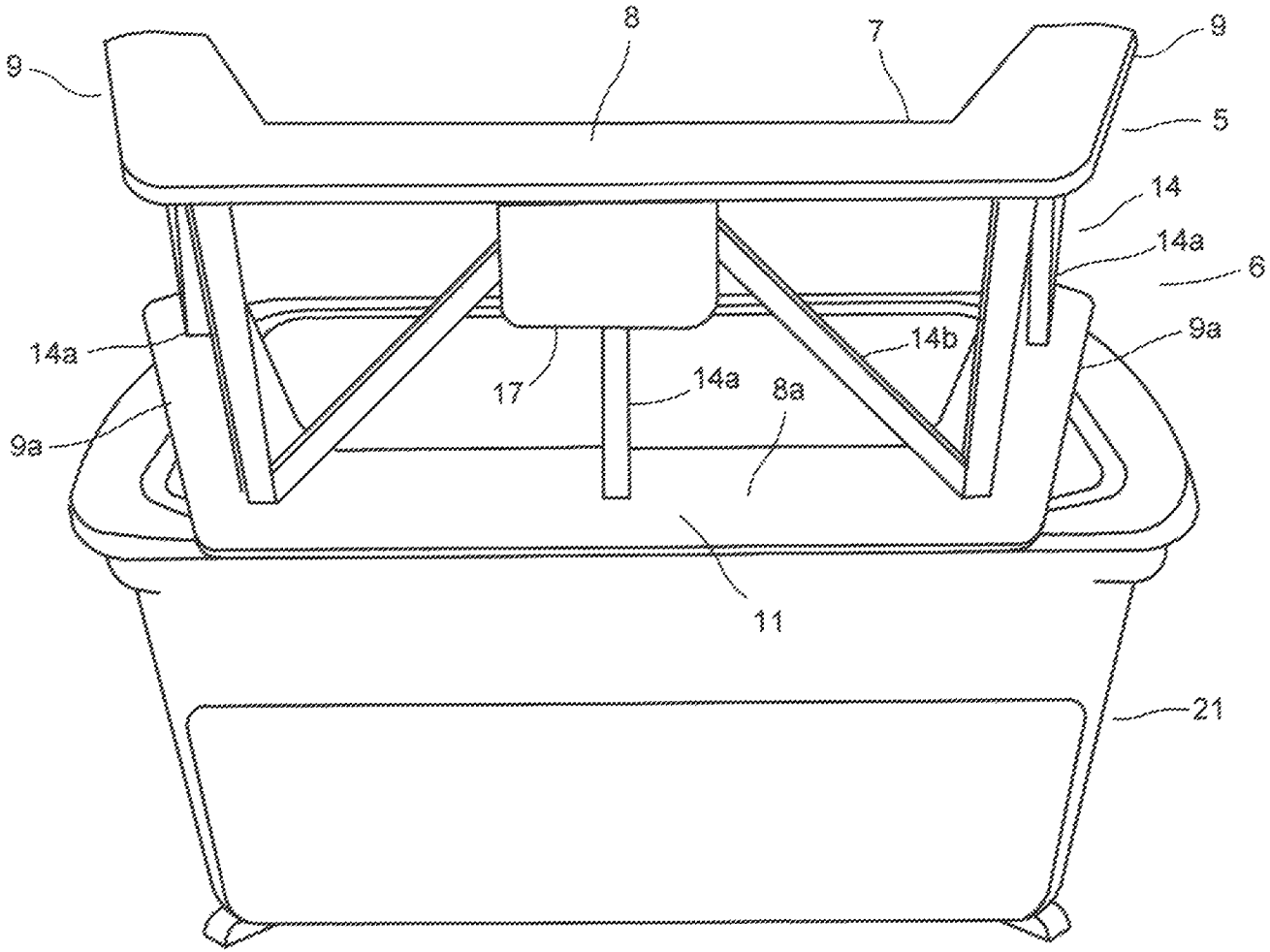
FIG. 1 shows a front perspective view of a first embodiment of the stand for the present invention wherein the frame portion of the stand of the present invention is shown mounted on a box for better viewing.
Figure 2:
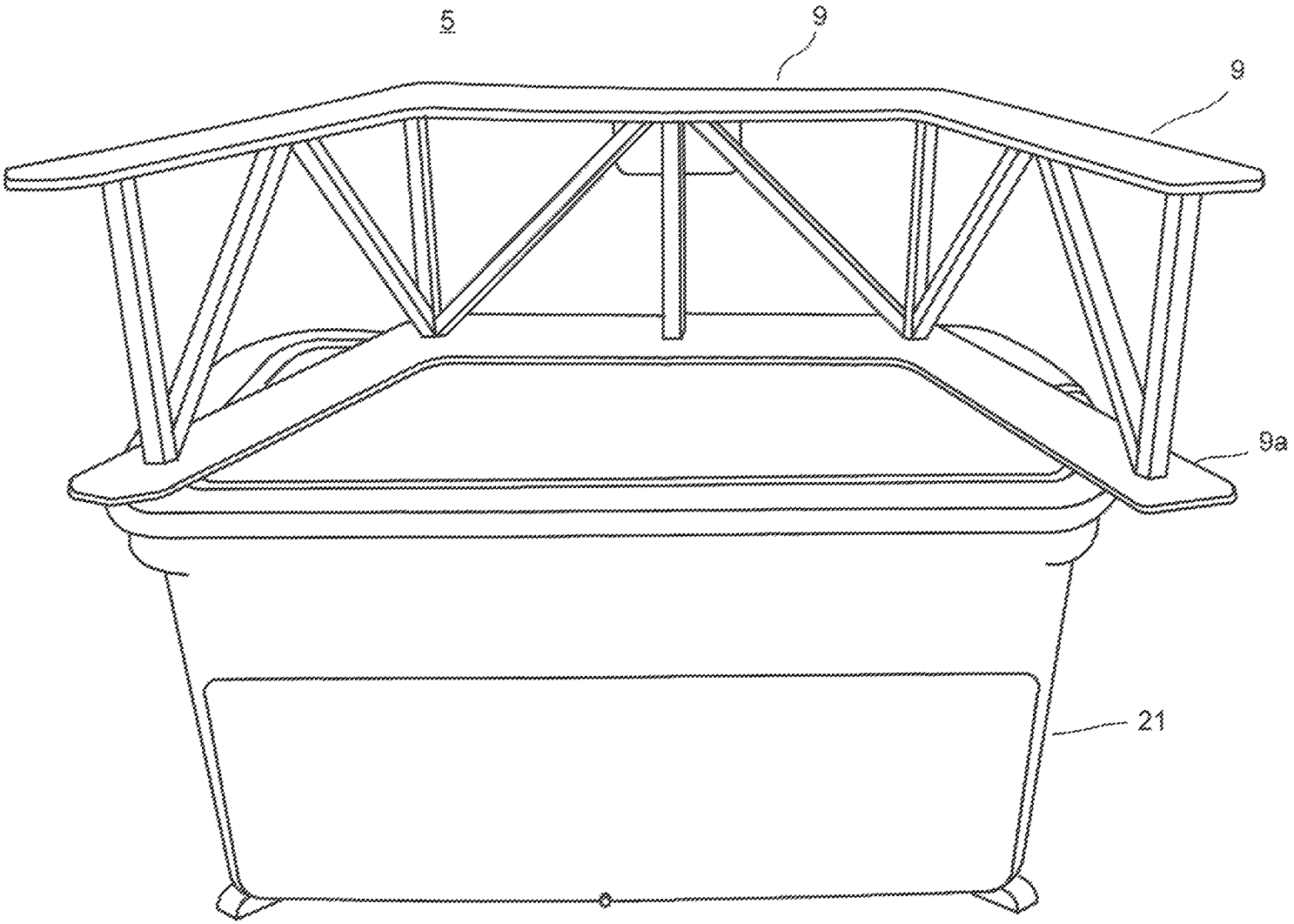
FIG. 2 shows a rear perspective view of the first embodiment of the stand of FIG. 1 for the present invention wherein the frame portion of the stand of the present invention is shown mounted on a box for better viewing.
Figure 3:
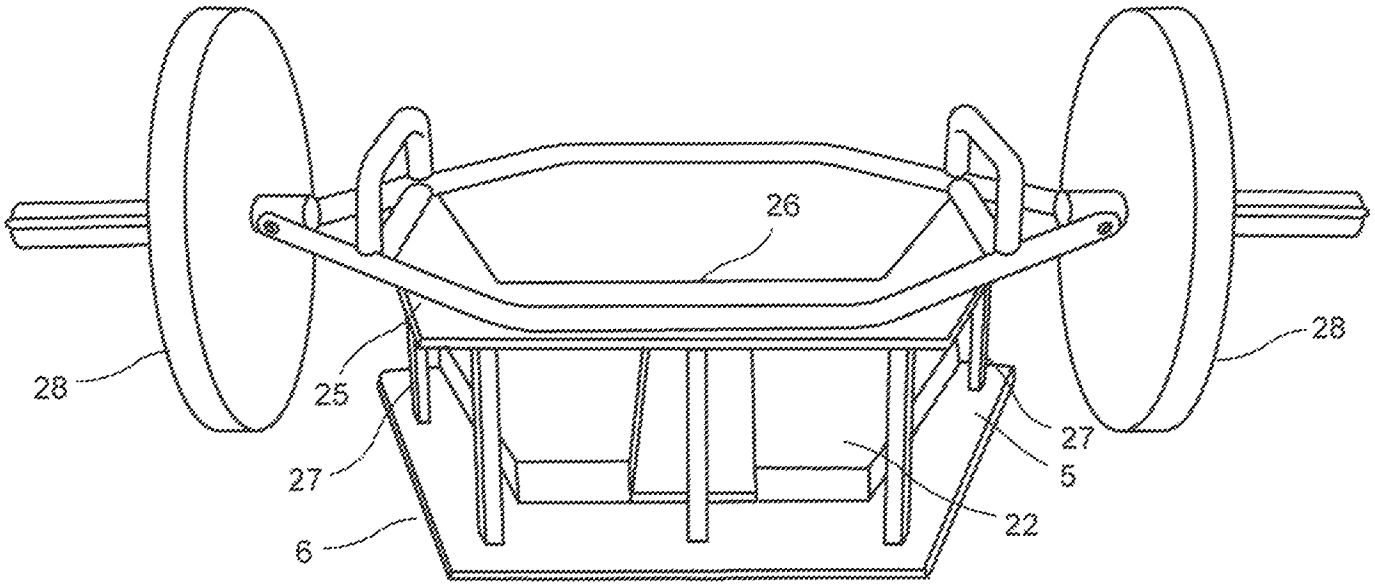
FIG. 3 shows another embodiment for the stand for the present invention in which the fully assembled stand of the present invention is shown having a floor board of having a thickness making it unnecessary for a user to squat fully down to lift the hexagonal bar or trap bar that is shown placed on the top surface areas of the stand.

Referring now to the drawings of FIGS. 1-3, FIGS. 1 and 2 show a first embodiment for the present invention in which the frame 6 for the stand 5 (See FIG. 3) of the present invention is shown having a top surface 7 formed of a substantially flat planar front portion 8 and two side arm portions 9 that are angled outward as they extend back from where the side arms 9 meet with and are in preferably integrally connected and formed with the front portion arm 8 of the top surface 7. Similarly the bottom surface 11 is formed of a substantially flat planar front portion 8*a* and two side arm portions 9*a* that are angled outward as they extend back from where the side arms 9*a* meet with and are in preferably integrally connected and formed with the front portion arm 8*a* of the bottom surface 11. The top surface 8 and the bottom surface 11 are connected by connecting arms 14 including straight arms 14*a* extending between the top and bottom surfaces and preferably right angled arms 14*b* (preferably 90° angled to join as they extend toward the top surface) on each of the three sections of the frame are shown in FIGS. 1 and 2. The preferably right angled arms 14*b* and a straight arm 14*a* in the middle section of the frame 6 are located in the middle section 14*a* of the frame 6 join together with a preferably rectangular shaped junction portion 17 which can have a logo placed thereon for the device's product name for branding purposes. In FIGS. 1 and 2 the frame 6 of the stand 5 (See FIG. 3) is mounted on a box 21 for better viewing. It is understood that the present invention is not limited to any particular straight arm or angled arm configuration and can use any, either or both in various configurations of support arms, all within the scope of the present invention.

The stand 5 as shown in FIGS. 1-3 is preferably formed of metallic material such as but not limited to steel, a metallic alloy or else plastic material preferably hard strong plastic material or else graphite material.

FIG. 3 shows another embodiment for the stand 5 for the present invention in which the fully assembled stand 5 of the present invention is shown having a floor board 22 having a thickness making it unnecessary for a user to squat fully down to lift the hexagonal bar or trap bar 25 that is shown placed on the top surface areas 7 of the stand 5. In FIG. 3 the stand is fully assembled with a floor board having a preferred thickness sufficient so that a user gets the benefit of exercising full of range of motion of as if he was squatting down to the ground when standing in the area encased by the stand This preferred thickness of the floor board 22 is preferably one inch thick.

In FIG. 3 the hexagonal bar or trap bar 25 can be seen placed on the top surface areas of the stand 5. The stand 5 has preferably a rubber coating of the top surfaces of the stand 5 to protect the stand 5 from the bar 25. The rubber coating can be formed as rubber strips that adhere or are otherwise affixed or connected to the top surfaces of the stand 5 but it is understood that the present invention is not limited to this one way of rubber coating. The stand 5 can preferably have a polysided encasement except for the opening 26 for a user to enter somewhat resembling u-shaped type configuration with corners being rounded so as to protect the user and the corners 27 also being rubber coated to protect the user from injury due to sharp corners. As stated above the stand 5 preferably has an approximately a 1 inch thick bottom floor board 2 or surface 26 from the ground of the area into which the user steps into the stand so that a user gets the benefit of exercising full of range of motion of as if he was squatting down to the ground when standing in the area encased by the stand.

The stand 5 has the following preferred but not limited to dimensions:

The stand 5 is preferably approximately 9 inches high from the ground to ensure that the bar 25 is off the ground for preferably approximately ¾ inch making it easier to remove and replace the weight plates 21. In addition the front width of the stand is preferably approximately 21 inches.

The rear width of the stand 5 is preferably approximately 30 inches. The length of the sides of the stand is preferably approximately 21 inches. The length of the middle of the stand is preferably approximately 30 inches.

The stand 5 facilitates the removal and replacement of the weight plates without the need to lift the bar 25 upward from the ground and serves as a weight rack 5 for the hexagonal bar or the trap bar 25. The stand 5 permits a user to work in the area encased by the stand 5 if preferred. The stand 5 has an opening 26 for a user to enter and step in the hexagonal bar or trap bar 25 without having to lift the bar 25 upward from the stand 5 and permits the stand 5 area to be used for weight lifting so that the bar 25 can be lifted on the without lifting the bar from the ground or floor when placed back on the top surfaces 7 of the stand 5 when the exercise regime is completed.

The stand 5 can be substantially or generally u-shaped shaped with an opening 26 with preferably a polysided shaped in the stand's 5 enclosed area into which a user can enter as shown in FIG. 3.

Figure 4A:
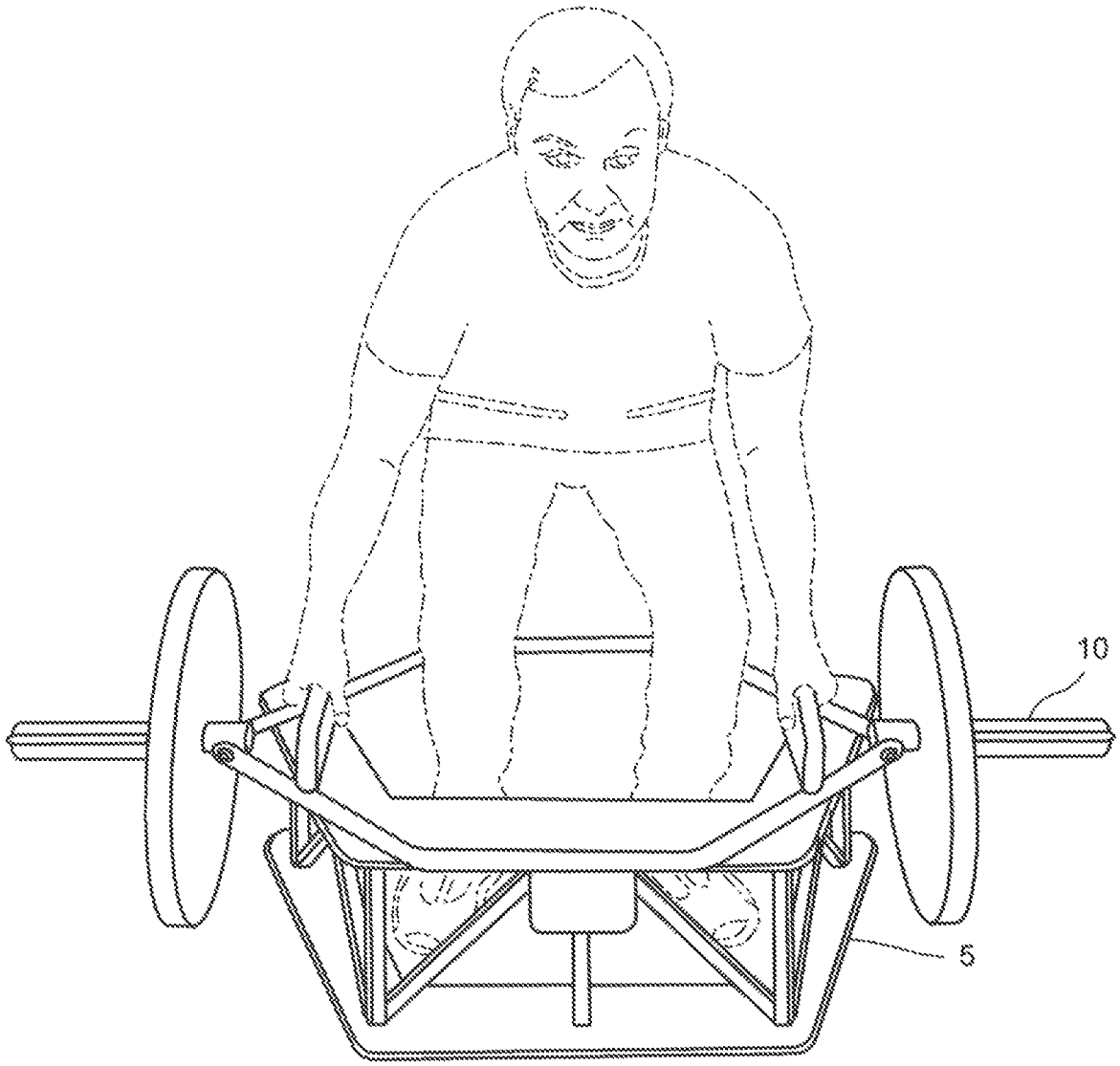
FIG. 4A shows the embodiment of FIG. 3 with a user demonstrating exercising with the stand and the bar where the user is standing in the area of the stand and is about to exercise and lift the hexagonal or trap bar from the stand of the invention.
Figure 4B:
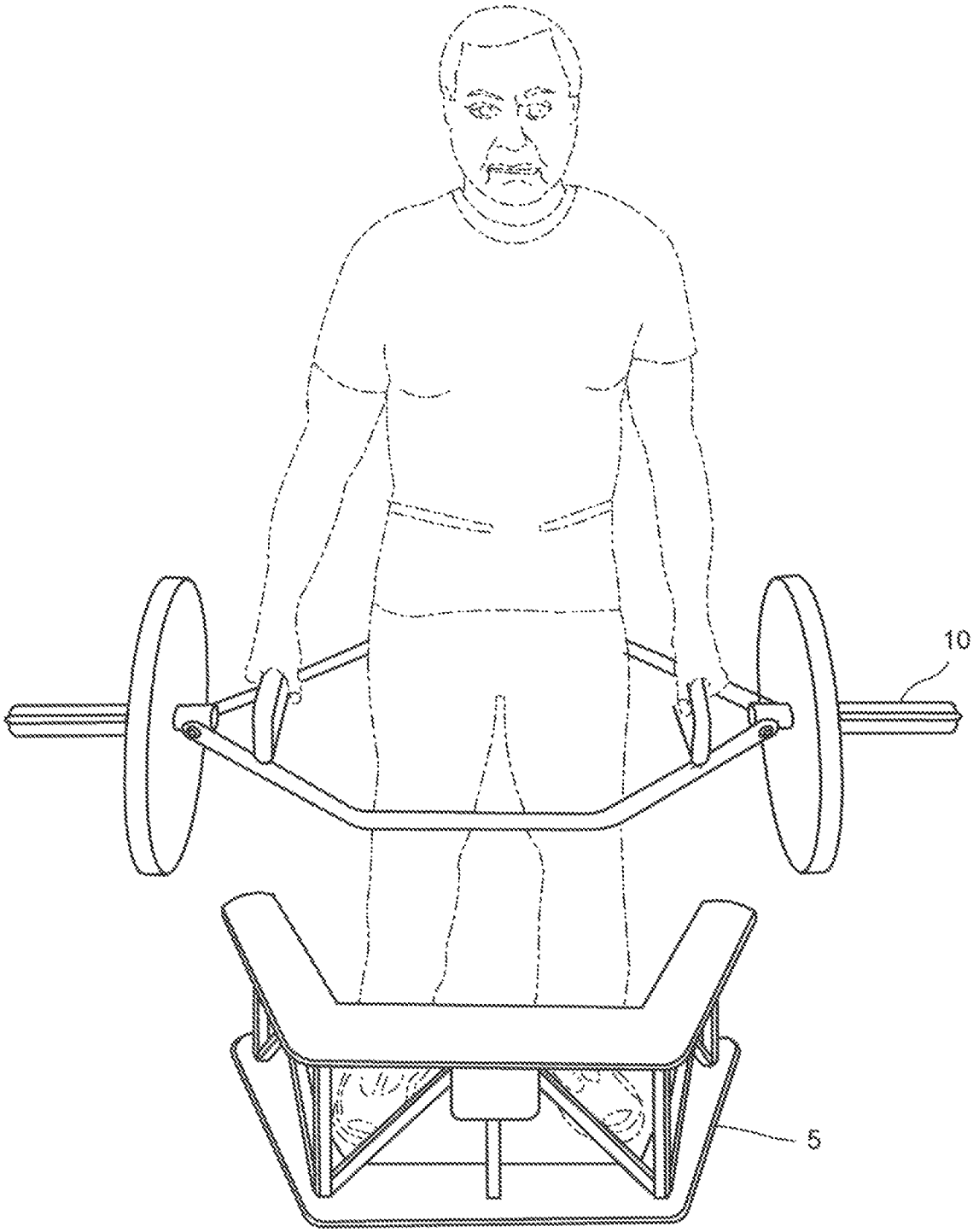
FIG. 4B shows the embodiment of FIG. 4A with a user demonstrating exercising with the stand and the bar where the user is standing in the area of the stand and is exercising and has lifted the hexagonal or trap bar from the stand of the present invention.

FIG. 4A shows the embodiment of FIG. 3 with a user demonstrating exercising with the stand 5 and the bar 25 where the user is standing in the area of the stand 5 and is about to exercise and lift the hexagonal or trap bar 25 from the stand 5 of the invention;

FIG. 4B shows the embodiment of FIG. 4A with a user demonstrating exercising with the stand and the bar where the user is standing in the area of the stand 5 and is exercising and has lifted the hexagonal or trap bar 25 from the stand 5 of the present invention.

Figure 5A:
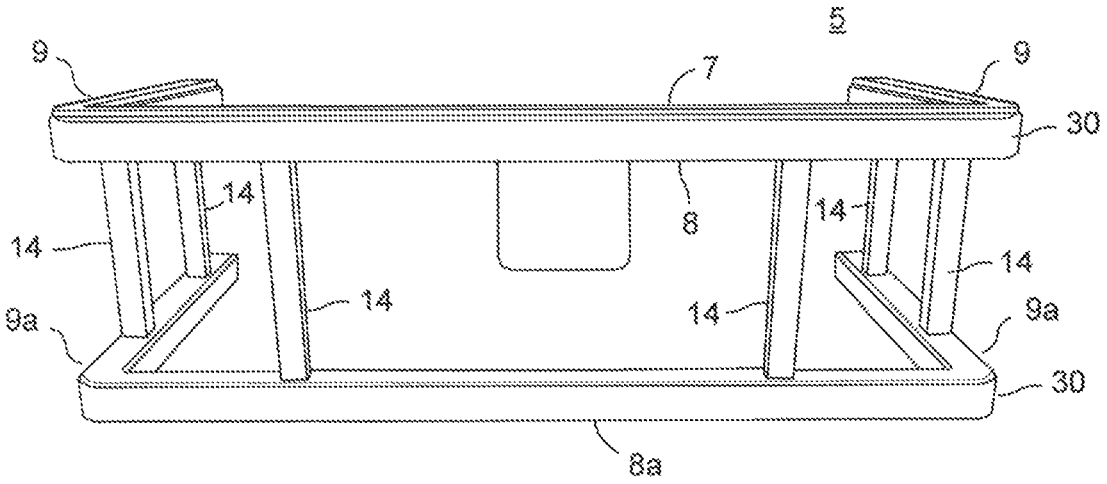
Figure 5B:
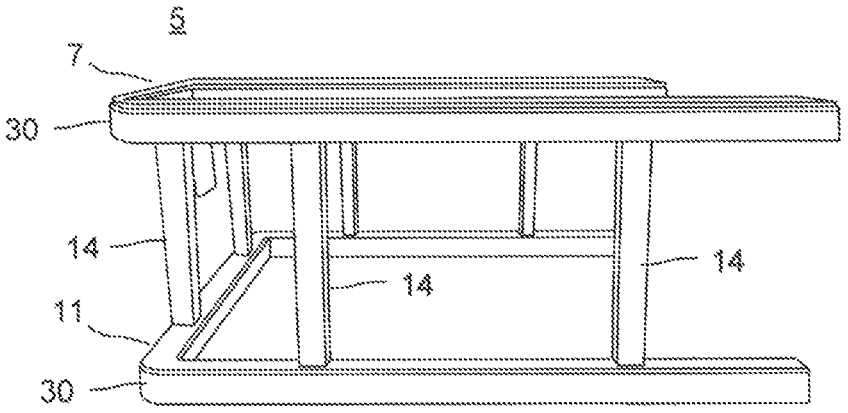
Figure 5C:
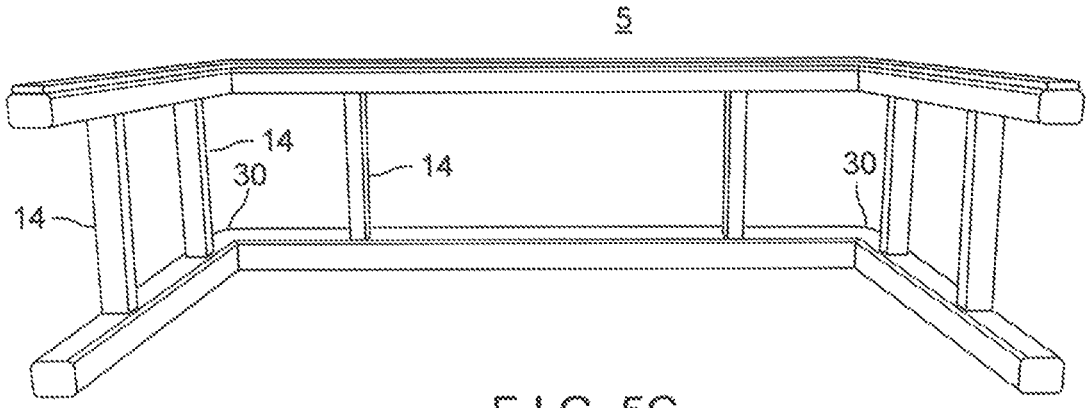

Another embodiment of the present invention is shown in FIGS. 5A-5C wherein:

FIG. 5A shows a front perspective view of another embodiment of the present invention in which the connecting arms 14 extend vertically from the bottom portions 11 to the top portions 7 of the rack or stand 5 and the corners 30 on the top 7 and bottom 11 portions are curved. The curved portions 30 are preferably formed of steel and have preferably have an angle of 90 degrees and are preferably welded into the top and bottom portions 7 and 11, respectively. This way the corners are not sharp by being curved thus avoiding potential injury to a user.

Figure 6A:
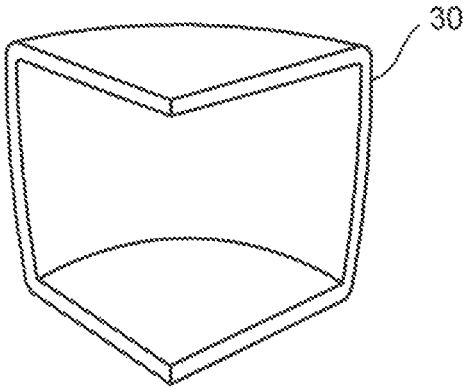
Figure 6B:
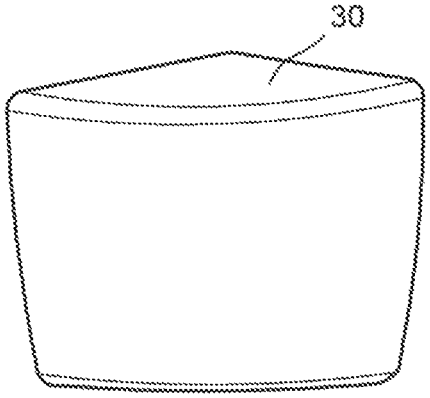
Figure 6C:
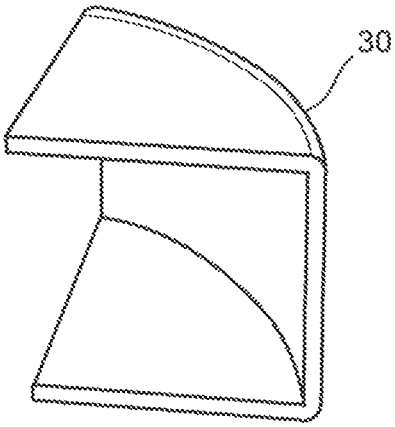
Figure 6D:
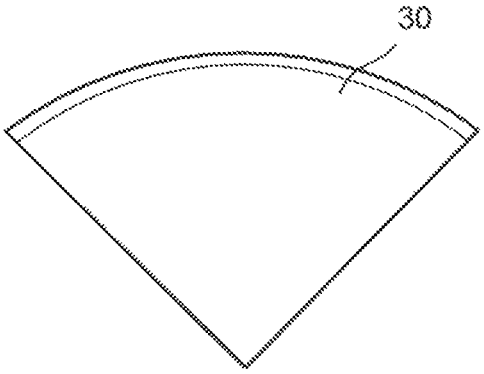
FIG. 6D is atop perspective view of FIG. 6A.
Figure 7A:
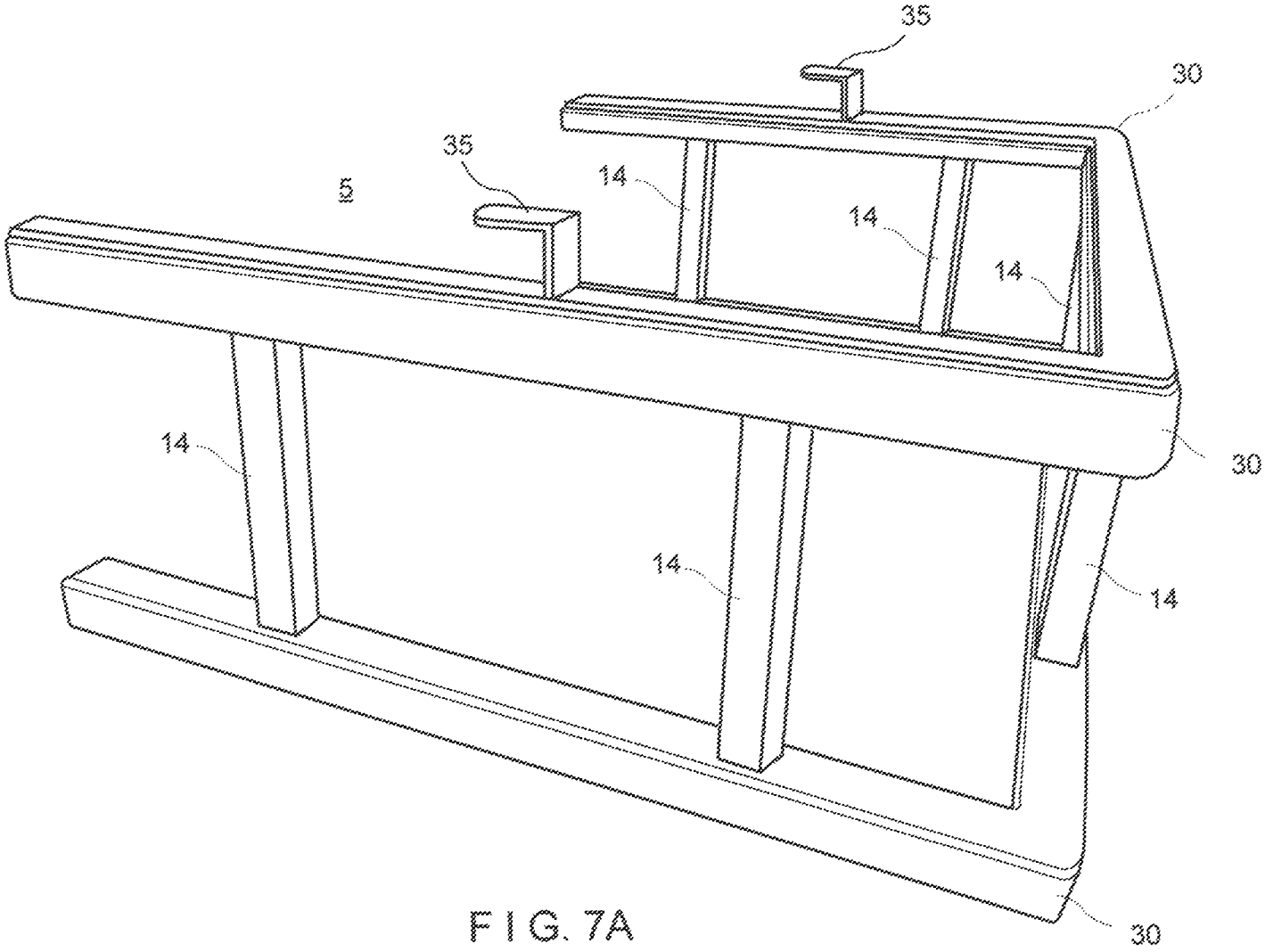
Figure 7B:
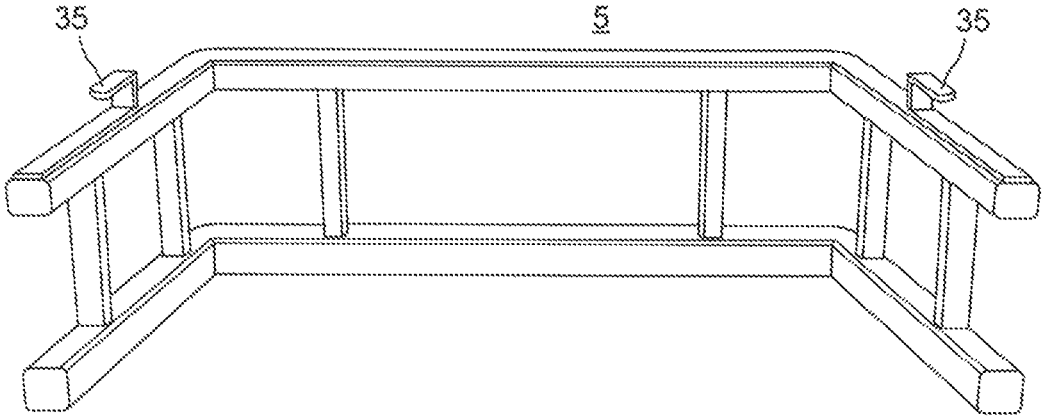
Figure 7C:
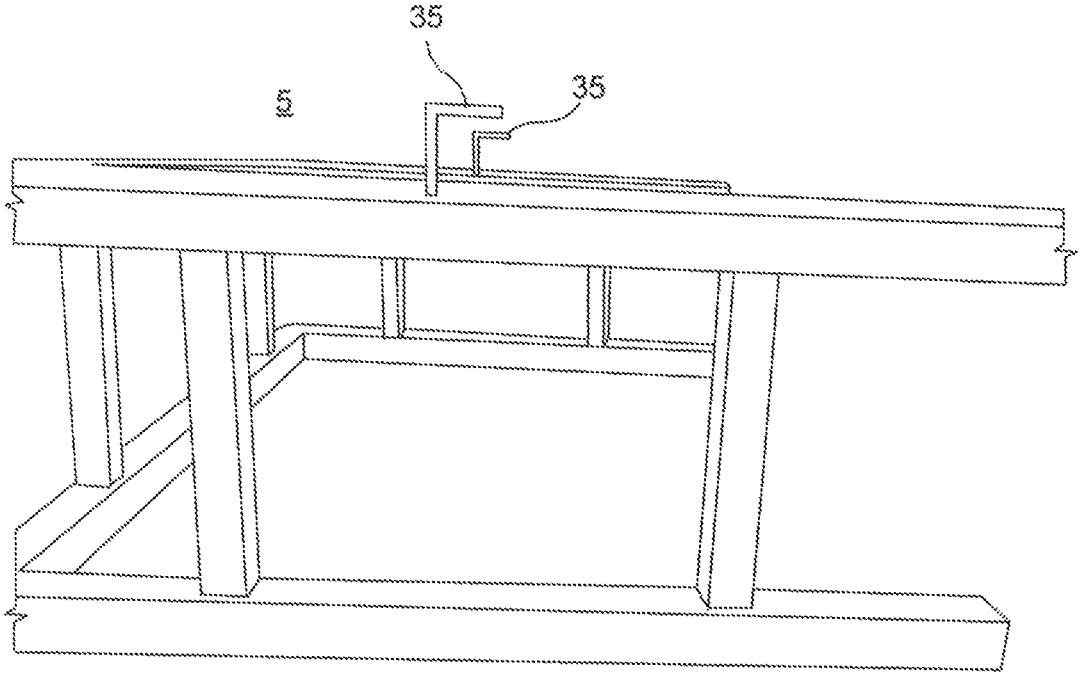

FIG. 5B is a right side perspective view of the embodiment of FIG. 5A;

FIG. 5C is a left side perspective view of the embodiment of FIG. 5A;

FIG. 6A-6C illustrates the curved portion 30 of the embodiment of FIGS. 5A-5C in more detail;

FIG. 6A shows a front perspective view of the curved portion 30 forming the corners in the top portion and bottom portion of the rack in the embodiment of the of FIGS. 5A-5C which is preferably welded into the front and side arms of the top and bottom portions of the rack;

FIG. 6B is a rear perspective view of FIG. 6A;

FIG. 6C is a side perspective view of FIG. 6A;

FIG. 6D is atop perspective view of FIG. 6A;

FIGS. 7A-7C show a fastening tool 35 for fastening the weights 10 to the rack 5 to secure the weights in place in accordance with the present invention in which:

FIG. 7A is a side perspective view of an L-shaped bracket tool 35 adapted to secure the weights to the top of the top portion of the rack of the present invention;

FIG. 7B shows the tool 35 on the rack 5 from the rear of the tool in accordance with the embodiment of FIG. 7A; and FIG. 7C is another side perspective view of an L-shaped bracket tool 35 adapted to secure the weights 10 to the top of the top portion 7 of the rack 5 of the present invention in accordance with the embodiment of FIG. 7A.

While presently preferred embodiments have been described for purposes of the disclosure, those skilled in the art can make numerous changes in the arrangement of method steps. Such changes are encompassed within the spirit of the invention as defined by the appended claims.

What is claimed:

1. A stand for a hexagonal bar or a trap bar for weights, the stand comprising:

a polysided encasement having an opening for a user to enter into said opening and step into said hexagonal bar or said trap bar, said encasement being formed as a frame including connecting arms, a top surface and a bottom surface, each of said surfaces including more than one section and said more than one section including a front section that is a middle section, and two side sections connected on respective sides of said middle section, said hexagonal bar or said trap bar top surface fully resting on said middle section and said side sections of said top surface of said stand and, said connecting arms connecting said top surface to said bottom surface, said connecting arms including straight arms extending between the top and bottom surfaces and angled arms that are angled to join as they extend toward said top surface on each of said more than one section of said frame, said top surface having said height above the ground on which the stand rests so that said hexagonal bar or said trap bar resting on said top surface having weight plates will be off the floor of the ground when resting on the top surface of the stand thereby facilitating the removal and replacement of the weight plates without the need to lift the bar upward from the stand and wherein an area of said opening encased by said stand has a bottom floor board or surface on the ground of the area into which the user steps into the stand so that the user gets the benefit of exercising full range of motion as if said user was squatting down to the ground when standing in the area encased by the stand.

2. The stand according to claim 1 wherein said stand is formed of metallic material.

3. The stand according to claim 2 wherein said metallic material of said stand is formed of steel.

4. The stand according to claim 2 wherein said metallic material of said stand is formed of a metallic alloy.

5. The stand according to claim 1 wherein said stand comprises said connecting arms that extend vertically from the top surface to the bottom surface of the stand.

6. The stand according to claim 5 wherein said straight arms comprises vertically extending connecting bars including at least two bars at the front section connecting the top and bottom surfaces and at least two bars on each of the side sections connecting the top and bottom surfaces at their respective side sections.

7. The stand according to claim 1 wherein said frame has a rubber coating of the top surfaces on the stand to protect the stand from the bar.

8. The stand according to claim 1 wherein said frame is U-shaped except for the opening for the user to enter, said frame has corners that are rounded and said corners are rubber coated to protect the user.

9. The stand according to claim 1 wherein said stand is formed of plastic material.

10. The stand according to claim 1 wherein said stand is formed of graphite material.

11. The stand according to claim 1 wherein said stand is approximately 9 inches high from the ground to ensure that the bar is off the ground for approximately ¾ inch making it easier to remove and replace the weight plates.

12. The stand according to claim 1 said stand further comprising curved corner portions that have an angle of approximately 90 degrees.

13. The stand according to claim 1 wherein said stand further comprises curved corner portions made of steel.

14. A combination comprising:

a hexagonal bar or a trap bar;

a stand for said hexagonal bar or said trap bar, said stand comprising a polysided encasement for encasing an opening for a user to enter into said opening and step into said hexagonal bar or said trap bar and said encasement being formed as a frame including connecting arms and a top surface and a bottom surface, the connecting arms include straight arms that extend between said top and bottom surfaces and include angled arms that are angled as they extend toward said top surface, each of said surfaces including more than one section and said more than one section including a front section that is a middle section and two side sections, one side section of said two side sections on each side of said middle section and said straight arms that extend between said top and bottom surfaces, said hexagonal bar or said trap bar top surface fully resting on said middle section and said side sections of said top surface of said stand, said top surface having a height above the ground on which the stand rests, and said hexagonal bar or said trap bar resting on said top surface having weight plates will be off the floor of the ground when resting on the to surface of the stand thereby facilitating the removal and replacement of the weight plates without the need to lift said bar upward from the stand and wherein an area of said opening encased by said stand has an approximately 1 inch thick bottom floor board or surface on the ground of the area into which the user steps into the stand so that the user gets the benefit of exercising full range of motion as if said user was squatting down to the ground when standing in the area encased by the stand.

15. The combination according to claim 14 wherein said stand is formed of metallic material.

16. The combination according to claim 15 wherein said metallic material of said stand is steel.

17. The combination according to claim 15 wherein said metallic material of said stand is formed of a metallic alloy.

18. The combination according to claim 14 wherein said top and bottom surfaces have corners, said corners of said top and bottom surfaces include curved corner portions in order to prevent injury to the user from sharp corners.

19. The combination according to claim 18 wherein said curved corner portions have an angle of approximately 90 degrees.

20. The combination according to claim 18 wherein said corner portions are made of steel.

21. The combination according to claim 14 wherein said frame has more than one section and said stand has said opening permitting the user to exercise in the area of the stand and said top surface and said bottom surface of said frame of said stand are connected by said connecting arms.

22. The combination according to claim 14 wherein said frame has a rubber coating of the top surface of the stand to protect the stand from said hexagonal bar or said trap bar.

23. The combination according to claim 14 wherein said frame of said stand has said polysided encasement except for the opening for the user to enter resembling a u-shaped configuration with corners, being rounded so as to protect the user and the corners also being rubber coated to protect the user.

24. The combination stand according to claim 14 wherein said stand is formed of plastic material.

25. The combination according to claim 14 wherein said stand is formed of graphite material.

26. The combination according to claim 14 wherein said stand is approximately 9 inches high from the ground to insure that said hexagonal or trap bar is off the ground for approximately ¾ inch making it easier to remove and replace the weight plates.

27. The combination according to claim 14 wherein said connecting arms extends vertically from the top surface to the bottom surface of the stand.

28. The combination according to claim 27 wherein said connecting bars include vertically extending connecting arms which include at least two bars at the front section connecting the top and bottom surfaces and at least two bars on each of the side sections connecting the top and bottom surfaces at their respective side sections.

29. The combination according to claim 14 the combination further comprising an L-shaped bracket tool adapted to secure the weight plates to the top of the top surface of the stand.

* * * * *